US005857788A

United States Patent [19]

Gutsell et al.

[11] Patent Number: 5,857,788

[45] Date of Patent: Jan. 12, 1999

[54] THERMAL PRINTING DEVICE WITH DIRECT THERMAL CASSETTE

[75] Inventors: Graham Scott Gutsell, Harston, United Kingdom; Geert Heyse, St. Katelijne Waver, Belgium

[73] Assignee: Esselte NV, St. Niklaas, Belgium

[21] Appl. No.: 747,125

[22] Filed: Nov. 8, 1996

[30] Foreign Application Priority Data

Nov. 10, 1995 [GB] United Kingdom ..... 9523053
Jul. 5, 1996 [GB] United Kingdom ..... 9614125

[51] Int. Cl.[6] ..... B41J 11/58

[52] U.S. Cl. ..... 400/613; 400/615.2; 400/708

[58] Field of Search ..... 400/615.2, 207, 400/208, 613, 708

[56] References Cited

U.S. PATENT DOCUMENTS

| | | | |
|---|---|---|---|
| 4,901,090 | 2/1990 | Ozawa et al. | 346/76 PH |
| 5,009,530 | 4/1991 | Kuzuya et al. | 400/615.2 |
| 5,028,934 | 7/1991 | Kasai et al. | 346/76 PH |
| 5,111,216 | 5/1992 | Richardson et al. | 346/76 PH |
| 5,183,333 | 2/1993 | Minowa | 400/605 |
| 5,324,123 | 6/1994 | Hattori | 400/207 |
| 5,358,351 | 10/1994 | Murata et al. | 400/605 |
| 5,454,659 | 10/1995 | Yamaguchi | 400/208 |
| 5,492,282 | 2/1996 | Okuchi et al. | 242/341 |
| 5,494,365 | 2/1996 | Nagae et al. | 400/703 |
| 5,496,119 | 3/1996 | Kawakami et al. | 400/615.2 |

FOREIGN PATENT DOCUMENTS

| | | |
|---|---|---|
| 0 634 274 A2 | 11/1985 | European Pat. Off. . |
| 0 354 815 | 8/1989 | European Pat. Off. . |
| 0 487 313 | 11/1991 | European Pat. Off. . |
| 0 526 078 | 7/1992 | European Pat. Off. . |
| 0 573 187 | 5/1993 | European Pat. Off. . |
| 0 577 271 | 6/1993 | European Pat. Off. . |
| 0 607 025 A | 7/1994 | European Pat. Off. . |
| 0 625 427 A2 | 11/1994 | European Pat. Off. . |
| 0 704 311 | 8/1995 | European Pat. Off. . |
| 2 161 754 | 7/1984 | United Kingdom . |

*Primary Examiner*—John Hilten
*Attorney, Agent, or Firm*—Pennie & Edmonds LLP

[57] ABSTRACT

A set of tape holding cases including at least two cases of a first type and at least two cases of a second type, with the cases of the first type housing image receiving tape of respectively different tape parameters and cases of the second type housing image transfer tape of respectively different tape parameters. Each case of the first type has a first cooperating component, depending on the tape parameter of image receiving tape, and each case of the second type has a second cooperating component, depending on the tape parameter of image transfer tape. The first and second cooperating components are arranged to selectively cooperate with each other to allow cooperation only of a properly selected case of the first type with any one of the cases of the second type and otherwise to exclude cooperation of the cases. Also, a thermal printing device having cassette receiving portions for these tape holding cases for use in thermal transfer printing.

15 Claims, 8 Drawing Sheets

THERMAL PRINTING DEVICE WITH DIRECT THERMAL CASSETTE

TECHNICAL FIELD

This invention relates to a thermal printing device which can operate with a direct thermal cassette, or with a substrate cassette used in cooperation with a thermal transfer cassette.

BACKGROUND ART

Thermal printing devices of the general type with which the present invention is concerned are known. They operate with a supply of tape arranged to receive an image and means for transferring an image onto the tape. In one known device, a tape holding case holds a supply of image receiving tape and a supply of an image transfer ribbon, the image receiving tape and the transfer ribbon being passed in overlap through a printing zone of the printing device. At the print zone, a thermal print head cooperates with a platen to transfer an image from the transfer ribbon to the tape. A printing device operating with a tape holding case of this type is described for example in U.S. Pat. No. 4,815,871, (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releaseable backing layer by a layer of adhesive.

Once an image or message has been printed on the tape, that portion of the tape is cut off to enable it to be used as a label. The releaseable backing layer is removed from the upper layer to enable the upper layer to be secured to a surface by means of the adhesive layer.

In another known printing device, described in U.S. Pat. No. 5,927,278, (Brother Kogyo K.K.), a tape holding case houses a supply of a transparent image receiving tape and a supply of an image transfer ribbon. The tape holding case also houses a supply of backing tape which comprises a carrier layer having an adhesive layer on its underside to which is secured a releaseable backing sheet and an adhesive layer on its upper side which can be secured to the image receiving tape after an image has been printed thereon. In this device, the image is printed onto the image receiving tape as a mirror image which, when viewed through the image receiving tape, is the correct way round. With this device, the print is protected when the label is used.

In all of these devices, the color of the label and the color of the print are predetermined by the contents of the tape holding case. By the color of the label reference is made to the upper layer of the image receiving tape of the apparatus described in EP-A-0267890 and to the carrier layer of the device described with reference to EP-0322918. The color of the print is determined by the color of the image transfer ribbon. Thus labels of one particular color can only be printed with ink of a particular color. Moreover, because the image receiving tape and image transfer tape are in the same tape holding case, they will run out together.

In another device disclosed in U.S. Pat. No. 4,480,936, two separate cassettes are provided which clip together to form a single unit which can then be inserted in a machine, the cassettes supplying ink ribbon and substrate tape from a side location towards a print station. In order to replace one cassette with another it is necessary to unclip the cassettes, replace the required cassette and reclip the new cassettes together before inserting them in a device. This makes the system awkward to use.

In another device, there are two cassettes with an ink ribbon cassette being located within a substrate tape cassette in a nested fashion, on a common side of the print zone. This means that it is fiddly and awkward to remove the ink ribbon cassette to change it. Also, the external dimensions of the ink ribbon cassette are determined by the dimensions of the substrate tape so that its size or capacity could only be increased at the expense of the substrate tape.

One printing device which overcomes the above problems is known from U.S. Pat. No. 5,458,423. That document discloses a printing device which has first and second cassette receiving portions arranged on opposed sides of a printing zone. The first cassette receiving portion is for receiving a tape holding case housing a supply of image transfer ribbon. The second cassette receiving portion is for receiving a tape holding case housing a supply of image receiving tape. In this way, the first and second tape holding cases can be individually removable and replaceable.

That printing device has a wide range of applications. However, it has the restriction that the widths of image receiving tape which are available currently have a maximum width of 19 mm. At present, tape widths of 6 mm, 12 mm and 19 mm of image receiving tape are available. These all cooperate with image transfer ribbon having a width of 19 mm. However, it is desirable to provide larger widths of image receiving tape, for example 24 mm and 32 mm. Clearly, image transfer ribbon having a width of 19 mm is not wide enough for the full extent of image receiving tape having a width of 24 mm or 32 mm. It would be desirable therefore to provide a tape holding case of image transfer ribbon having a greater width. This however presents a problem in the printing device of the type described in U.S. Pat. No. 5,458,423 that, if both widths of image transfer ribbon were available, a user could inadvertently attempt to use a tape holding case having an image receiving tape of a small width with a tape holding case having an image transfer ribbon of a large width (or vice versa). In the first case, the ink ribbon would extend beyond the image receiving tape and thus could transfer ink to the platen. In the second case, the image transfer ribbon would not be wide enough to transfer ink across the full extent of the image receiving tape.

SUMMARY OF THE INVENTION

According to a first aspect of the invention, there is provided a set of tape holding cases including at least two cases of a first type and at least two cases of a second type, cases of the first type housing image receiving tape of respectively different tape parameters and cases of the second type housing image transfer tape of respectively different tape parameters, wherein each case of the first type has a first cooperating means, depending on the tape parameter of image receiving tape and each case of the second type has a second cooperating means, depending on the tape parameter of image transfer tape, the first and second cooperating means being arranged to selectively cooperate with each other to allow cooperation only of a properly selected case of the first type with any one of the cases of the second type and otherwise to exclude cooperation of the cases.

In accordance with the described embodiment the tape parameter is the width of the tape. It is also possible to use the invention with other tape parameters such as substrate tape color, ink ribbon color, nature of substrate tape, nature of ink ribbon, to ensure that only properly matched tapes can cooperate.

One of the first and second cooperating means can comprise a component extending from the tape holding case, the shape of the component being dependent on the tape parameter of the tape.

The other of the first and second cooperating means can comprise a recess defined in the tape holding case, the shape of the recess depending on the tape parameter of the tape and being arranged to accommodate the component of only the properly selected tape holding case.

This arrangement has the advantage not only that tape holding cases can be "mixed and matched", but that it also can be ensured that the correct nature of image transfer ribbon is used only with an appropriate nature of image receiving tape. In the preferred embodiment, where the tape parameter is width, image transfer ribbon is provided in two widths, 19 mm and 28 mm. The 19 mm width is appropriate for use with image receiving tape having a width of 6 mm, 12 mm or 19 mm. The 28 mm width of image transfer ribbon is suitable for use with image receiving tape having a width of 24 mm or 32 mm.

According to the first aspect of the invention there is also provided a thermal printing device having a first cassette receiving portion for receiving a first tape holding case housing a supply of image receiving tape; a second cassette receiving portion for receiving a second tape holding case housing a supply of image transfer ribbon capable of printing an image; means for moving the image receiving tape through a printing zone in overlap with the image transfer ribbon so that an image can be transferred from the image transfer ribbon onto the image receiving tape, wherein the first and second tape holding cases are each selectable from first and second groups so as to be individually removable and replacable, the groups constituting a set of tape holding cases as defined hereinabove.

As the printing device has two separate receiving portions for the first and second tape holding cases, each case can be easily removed and located separately without affecting the other. As each tape holding case is received separately, one is not required to guide the other so they can be removed, mixed and matched as desired, subject only to selection of a proper nature of image transfer ribbon for a selected image receiving tape. Further, the size and capacity of each cassette is determined only by the cassette receiving portions and not by each other.

It is contemplated that a printing device of the above-mentioned type could operate without a thermal transfer ribbon. That is, the image receiving tape could be a so-called direct thermal tape on which an image can be generated by heat but without the interposition of a thermal transfer ribbon. If a tape holding case housing a direct thermal ribbon of this tape were to be inserted in a printing device, it would be advantageous to exclude the possibility of inserting a tape holding case housing image transfer ribbon at the same time.

According to a second aspect of the invention there is provided a thermal printing device having:

a first cassette receiving portion for receiving a first tape holding case housing a supply of image receiving tape on which an image is to be printed;

a second cassette receiving portion for receiving a second tape holding case housing a supply of image transfer ribbon;

means for moving the image receiving tape through a printing zone at which a thermal printing mechanism operates to transfer an image onto the image receiving tape, wherein the first tape holding case is selectable from a set of tape holding cases including at least one tape holding case containing a supply of direct thermal tape, the tape holding case housing direct thermal tape being configured to exclude the possibility of inserting a second tape holding case into the second cassette receiving portion; and wherein the first cassette receiving portion includes means for detecting that a first tape holding case housing direct thermal tape has been inserted.

Preferably, a tape holding case housing direct thermal tape is configured with a component extending from the tape holding case so that when inserted it extends into the first cassette receiving portion to exclude the possibility of inserting a tape holding case housing image transfer ribbon.

The invention also provides a set of tape holding cases including at least a case holding direct thermal tape, a case holding image receiving tape and a case holding image transfer ribbon, wherein the case holding image receiving tape and the case holding image transfer ribbon have respective cooperating means to allow them to be inserted together into a printing device, and wherein the case holding direct thermal tape is configured to exclude the possibility of the case holding image transfer tape being inserted into the printing device.

BRIEF DESCRIPTION OF THE DRAWINGS

For a better understanding of the present invention, and to show how the same may be carried into effect, reference will now be made by way of example to the accompanying drawings in which:

FIG. 1 shows in plan view two cassettes arranged in a printing device 1. The upper cassette 2 is located in a first cassette receiving portion 26 and contains a supply of image receiving tape 54 which passes through a print zone 3 of the printer to an outlet 5 of the printer. The image receiving tape 54 comprises an upper layer for receiving a printed image on one of its surfaces and having its other surface coated with an adhesive layer to which is secured a releaseable backing layer. The cassette 2 has a recess 6 for accommodating a platen 8 of the printer, and guide portions 22,24 for guiding the tape 54 through the print zone. The platen 8 is mounted for rotation within a cage moulding 10. As an alternative, the platen 8 could be mounted for rotation on a pin.

Figure 1:
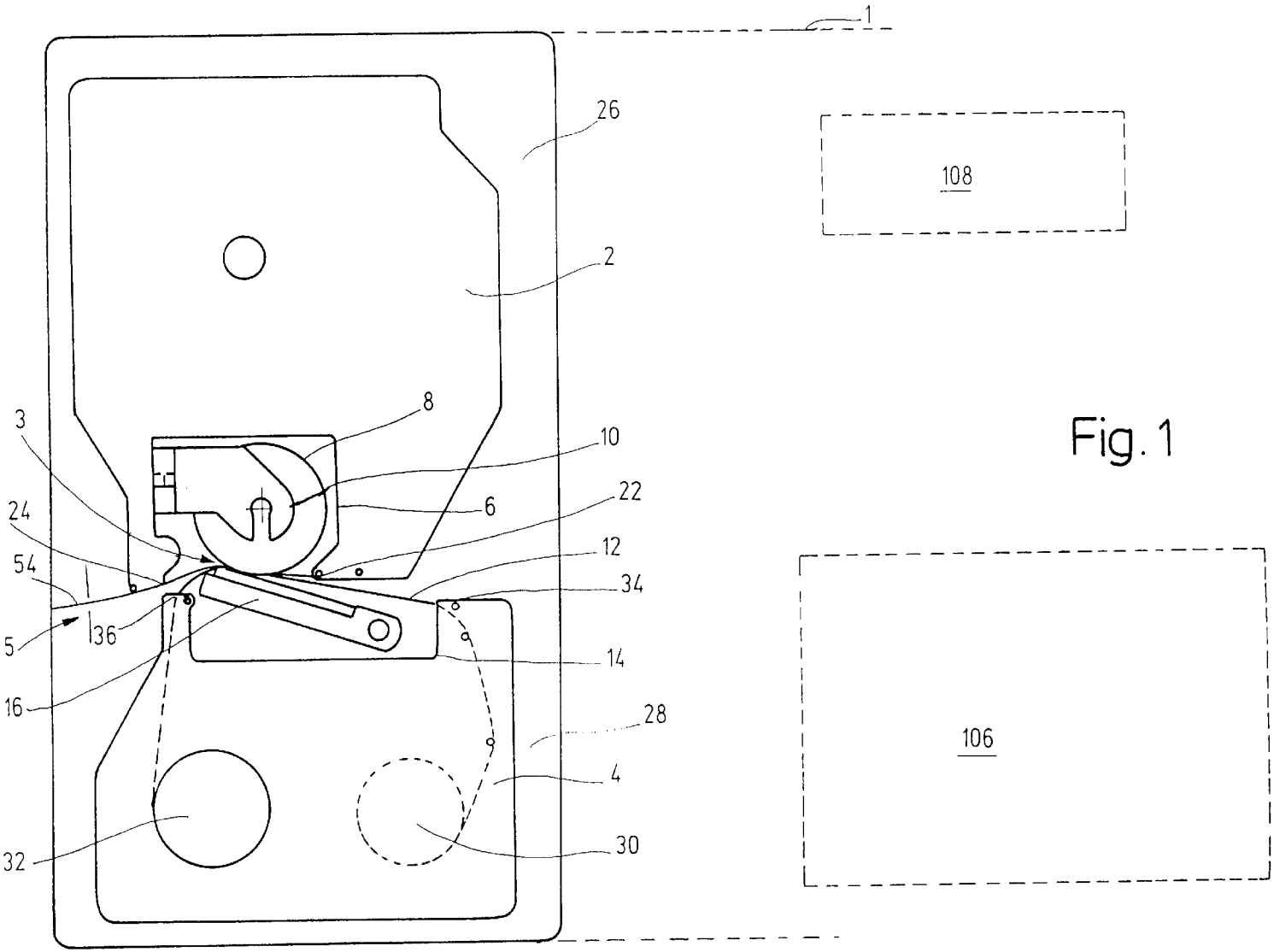
FIG. 1 is a plan view showing two cassettes inserted in a printing device.

The lower cassette 4 is located in a second cassette receiving portion 28 and contains a thermal transfer ribbon which extends from a supply spool 30 to a take-up spool 32 within the cassette 4. The thermal transfer ribbon 12 extends through the print zone 3 in overlap with the image receiving tape 4. The cassette 4 has a recess 14 for receiving a print, head 16 of the printer and guide portions 34,36 for guiding the ink ribbon 12 through the print zone 3. The print head 16 is movable between an operative position, shown in FIG. 1, in which it is in contact with the platen and holds the thermal transfer ribbon 12 and the image receiving tape in overlap between the print head and the platen and an inoperative position in which it is moved away from the platen to release the thermal transfer ribbon and image receiving tape. In the operative position, the platen is rotated to cause image receiving tape to be driven past the print head and the print head is controlled to print an image onto the image receiving tape by thermal transfer of ink from the ribbon 12. The print head is a conventional thermal print head having an array of pixels each of which can be thermally activated in accordance with the desired image to be printed.

The printing device has a lid which is not shown but which is hinged along the rear of the cassette receiving portion and which covers both cassettes when in place.

A motor drives the platen 8 while sequential columns are printed on the image receiving tape 54. The platen 8 drives the image receiving tape through the print zone under the action of its own rotation. The rotation of the platen and the energisation of the print head 16 are controlled by a microprocessor for example as described in our European Application Publication Nos. 0578372 and 0580322, the contents of which are herein incorporated by reference.

Figure 2:
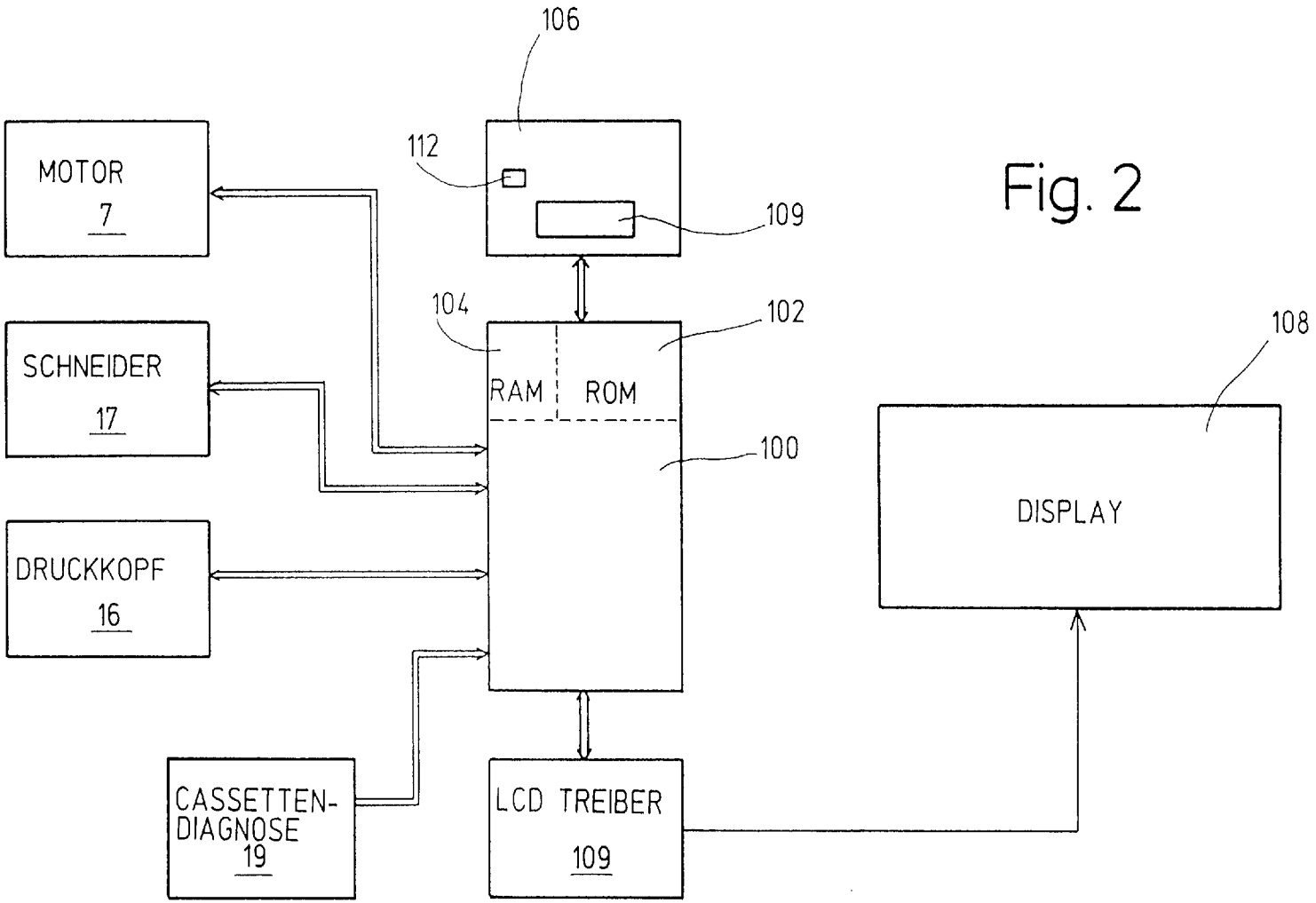
FIG. 2 is a diagrammatic sketch showing the control circuitry for the printing device.

The basic circuitry for controlling the printing device is shown in FIG. 2. There is a microprocessor chip 100 having read only memory (ROM) 102, a microprocessor 101 and random access memory capacity indicated diagrammatically by RAM 104. The microprocessor is connected to receive data input to it from a data input device such as a keyboard 106. The microprocessor chip 100 outputs data to drive a display 108 via a display driver chip 109 and also to drive the print head 16 and the stepper motor 7 for controlling the platen 8. The microprocessor chip also controls a cutting mechanism including a cutter 17 to cut off lengths of printed tape. The keyboard and display are located on the upper surface of the printing device to the right hand side of the cassette receiving portion as indicated by the dotted lines.

Reference numeral 19 denotes cassette diagnostics which include switches in the cassette bays for detecting various cassette conditions as will be described in more detail hereinafter.

The operation of the printer will now be described. Data to be printed is typed into the printing device using data input keys on the keyboard 106. The data input keys are designated generally by the block 109 but will in practice comprise a plurality of lettered and numbered keys. As the data is entered into the keyboard 106 it is supplied to the microprocessor 101 which drives the display 108 to display the data as it is entered. To do this, for each character which is entered, the microprocessor calls up a stored version of the character from the ROM 102. As the character is stored in compressed form this font data is stored temporarily in the RAM 104 and is manipulated by the microprocessor 100 to generate pixel data to form the character. This pixel data is transmitted in one form to the display 108 and in another form to the print head for printing. Character data is not passed to the print head for printing until a print operation is executed. Firstly, the characters for the label are entered and edited using function keys on the keyboard 106 in conjunction with the display 108.

Once the final form of the label has been worked out, the microprocessor is aware of the pixel data to be printed and has also calculated the overall length of the label. When a print operation is instigated using the print key 112 a column of pixel data is transmitted to the print head which prints this column of the image receiving tape. The motor then moves the image receiving tape forward by one column width and the next column data is transferred to the print head and printed.

When the complete label has been printed, the motor moves the image receiving tape through a distance corresponding to the distance between the print head and a zone where cutting is implemented. A cutting operation is then executed by the cutter 17 to cut off the printed portion of the tape constituting the label.

Figures 3, 4, 5:
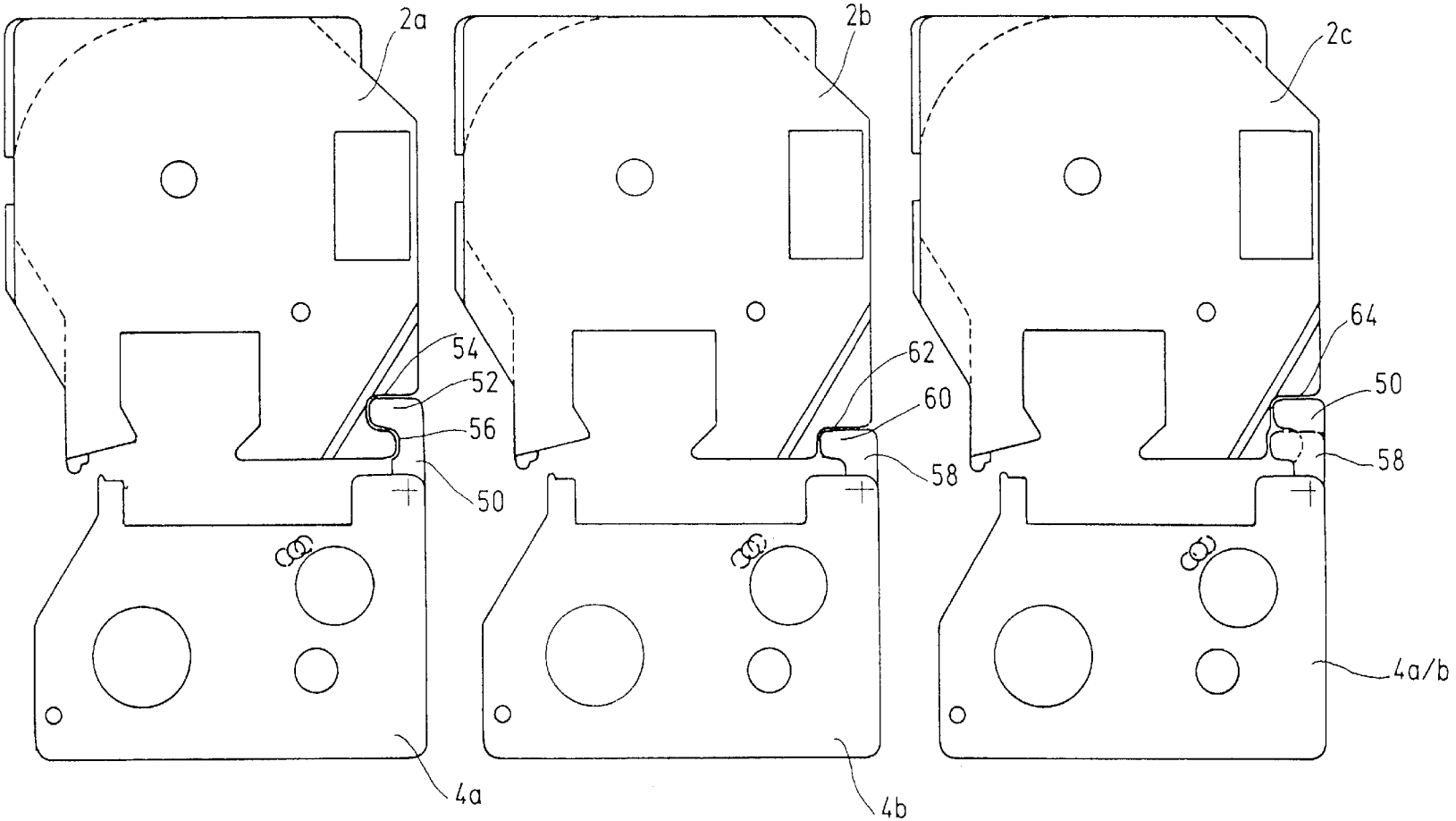
FIG. 3 is a diagram showing a set of tape holding cases with an image receiving tape of 6 mm (or 12 mm) and an image transfer tape of 19 mm.
FIG. 4 is a sketch showing a set of tape holding cases with an image receiving tape having a width of 24 mm (or 32 mm) and an image transfer ribbon having a width of 28 mm.
FIG. 5 is a sketch showing a set of tape holding cases with an image receiving tape having a width of 19 mm and an image transfer ribbon having a width either of 19 mm or of 28 mm.

FIG. 3 shows a tape holding case 4*a* similar to the tape holding case 4 of FIG. 1. Similarly, FIG. 3 also discloses a tape holding case 2*a* similar to the tape holding case 2 of FIG. 1. The tape holding case 4*a* is essentially the same as that described above with reference to FIG. 1, but additionally includes an interlock element 50 which extends from the tape holding case 4*a*. The interlock element 50 terminates in a hooked portion 52.

The tape holding case 2*a* is similar to that described above with reference to FIG. 1, but has in its casework a recess 54 which is sized to accommodate the interlock element 50. The recess 54 has a ledge 56 over which the hooked portion 52 of the interlock element 50 is located. In FIG. 3, the image transfer ribbon has a width of 19 mm and the image receiving tape has a width of 6 mm or 12 mm. The interlock element 50 cooperates with the recess 54 to allow cooperation of these tape holding cases in the printing device.

FIG. 4 illustrates a different set of tape holding cases. The tape holding case 4*b* shown in FIG. 4 is similar to that of 4*a* except that it houses image transfer ribbon of a wider width, for example 28 mm. It is also provided with an interlock element 58 which has a hooked portion 60 located closer to a surface of the tape holding case 4*b* than the hooked portion 52 of the interlock element 50 in FIG. 3.

The tape holding case 2*b* is similar to the tape holding case 2*a* of FIG. 3 but houses an image receiving tape of a wider width, for example 24 mm or 32 mm. The tape holding case 2*b* has a recess 62 which accommodates the interlock element 58 but which does not define a ledge. In this way, the set of tape holding cases of FIG. 4 are allowed to cooperate.

However, it will readily be apparent that if an attempt was made to insert a tape holding case 4*b* into a printing device which housed a tape holding case 2*a* (of narrow tape width), the hooked portion 60 of the interlock element 58 would interfere with the ledge 56 of the recess 54 and thus not permit the tape holding case 4*b* to be inserted. Similarly, if an attempt was made to insert a tape holding case 4*a* of narrow tape width into a printing device which held a tape holding case 2*b* of wider tape width, the interlock element 50 would not fit within the recess 62, and therefore the tape holding cases could not cooperate. Thus, the possibility of selecting the wrong width of image transfer ribbon for the selected image receiving tape is prevented.

FIG. 5 shows a set of tape holding cases wherein the tape holding case 2*c* has an image receiving tape of a width of 19 mm. This could without difficulty cooperate with an image transfer tape having a thickness of 19 mm or 28 mm. Thus, the tape holding case 2*c* has a so-called double recess 64. This double recess will accommodate both the interlock element 58 of the tape holding case 4*b* or the interlock element 50 of the tape holding case 4*a*. To denote this, the tape holding case holding image transfer ribbon in FIG. 5 is noted 4*a*/*b*. This indicates that either of the tape holding cases could cooperate properly with a tape holding case 2*c* having a tape width of 19 mm.

In a very simple fashion therefore, the possibility to use the wrong width of image transfer ribbon with the wrong width of image receiving tape is prevented in a printing device.

Figure 6:
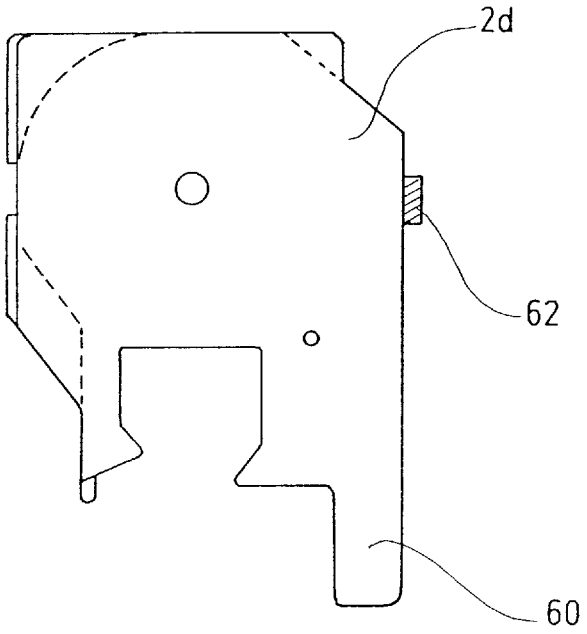
FIG. 6 is a plan view of a direct thermal tape holding case.

FIG. 6 illustrates a tape holding case 2*d* housing direct thermal tape. The tape holding case has an extended portion 60 which extends into the second cassette receiving portion when the tape holding case 2*d* is inserted into the first cassette receiving portion. Thus, it is not physically possible to insert a tape holding case into the second cassette receiving portion when a direct thermal tape holding case has been inserted.

A direct thermal tape holding case 2*d* has an actuator 62 for actuating a switch mechanism in the first cassette receiving portion 26 to identify that a direct thermal tape holding case has been inserted. The switch mechanism in the first cassette receiving portion is included in the cassette diagnostics 19. A signal is sent to the controller 100 to identify that a direct thermal tape holding case has been inserted, and the controller alters the print energy for the printhead 16 accordingly. If necessary, other alterations to the operation of the printing device can be made.

Another aspect of the direct thermal tape holding case 2*d* of FIG. 6 will now be explained with reference to FIGS. 7A to 7D and 8A to 8D. In a known printing device described in EP 607023, a switch located in the second cassette receiving portion determines when a lid of the printing device is closed and when an ink cassette is present so that the machine only operates when these criteria have been satisfied. Such a machine would thus not operate unless an ink cassette were to be inserted. This problem is overcome by providing that the direct thermal tape holding case 2*d* is also arranged to actuate the same switch so that it gives the appearance to the controller 100 that an ink cassette is present so that the machine will operate.

One example of such a switch with its operating mechanism will now be described.

Figures 7A, 8A:
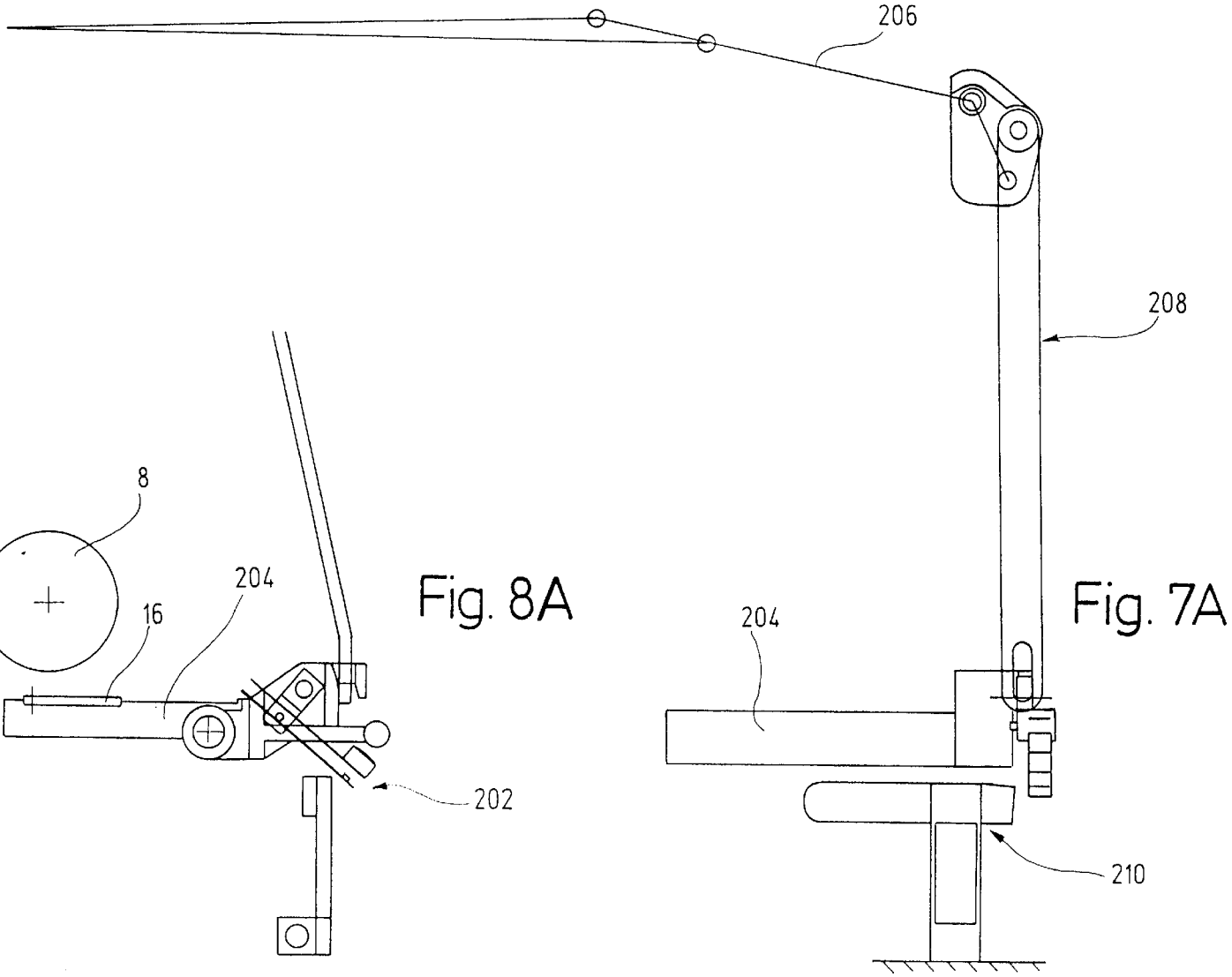
FIGS. 7A to 7D and 8A to 8D illustrate operation of a cassette bay switch.

The switch is denoted by reference numeral 202 (FIG. 8A) It is carried on a printhead arm 204 which also carries the printhead 16. The printhead arm is mounted to the cassette door 206 via an actuation mechanism 208, the details of which are not given herein. In short, when the door 206 is open, the printhead is brought into its inoperative position. When the door 206 is closed, the printhead is brought into its operative position. As the printhead arm 204 moves between the operative and inoperative positions, the switch 202 moves with it. Reference numeral 210 denotes a switch actuator which is located on the floor of the second cassette receiving portion. FIGS. 7A and 8A illustrate the situation where the door is open and there is no ink ribbon cassette.

Figure 7B:
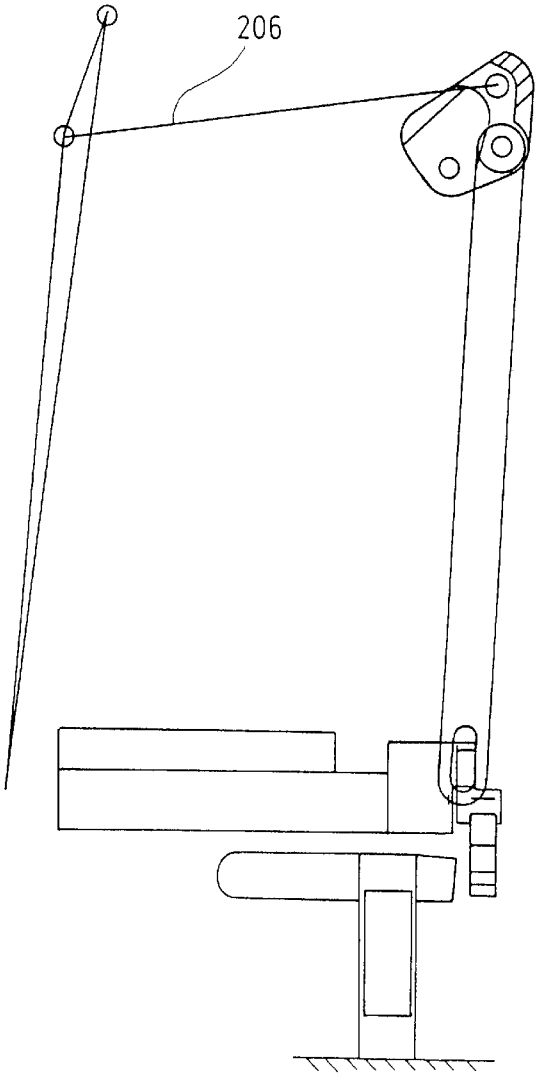
Figure 8B:
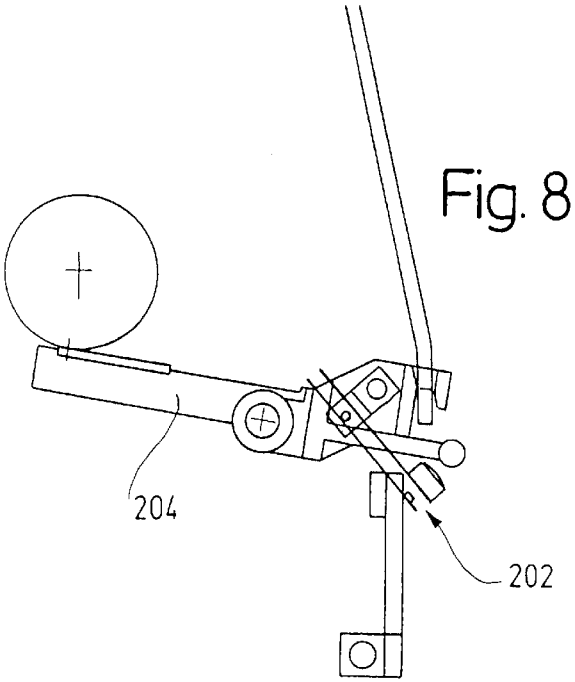

FIGS. 7B and 8B illustrate the situation when the door 206 is closed and there is still no cassette present. In that situation, the position of the switch 202 has moved with the printhead arm 204 but the terminals are still not in contact. Thus, the switch 202 remains open and the controller does not allow the device to operate.

Figures 7C, 8C:
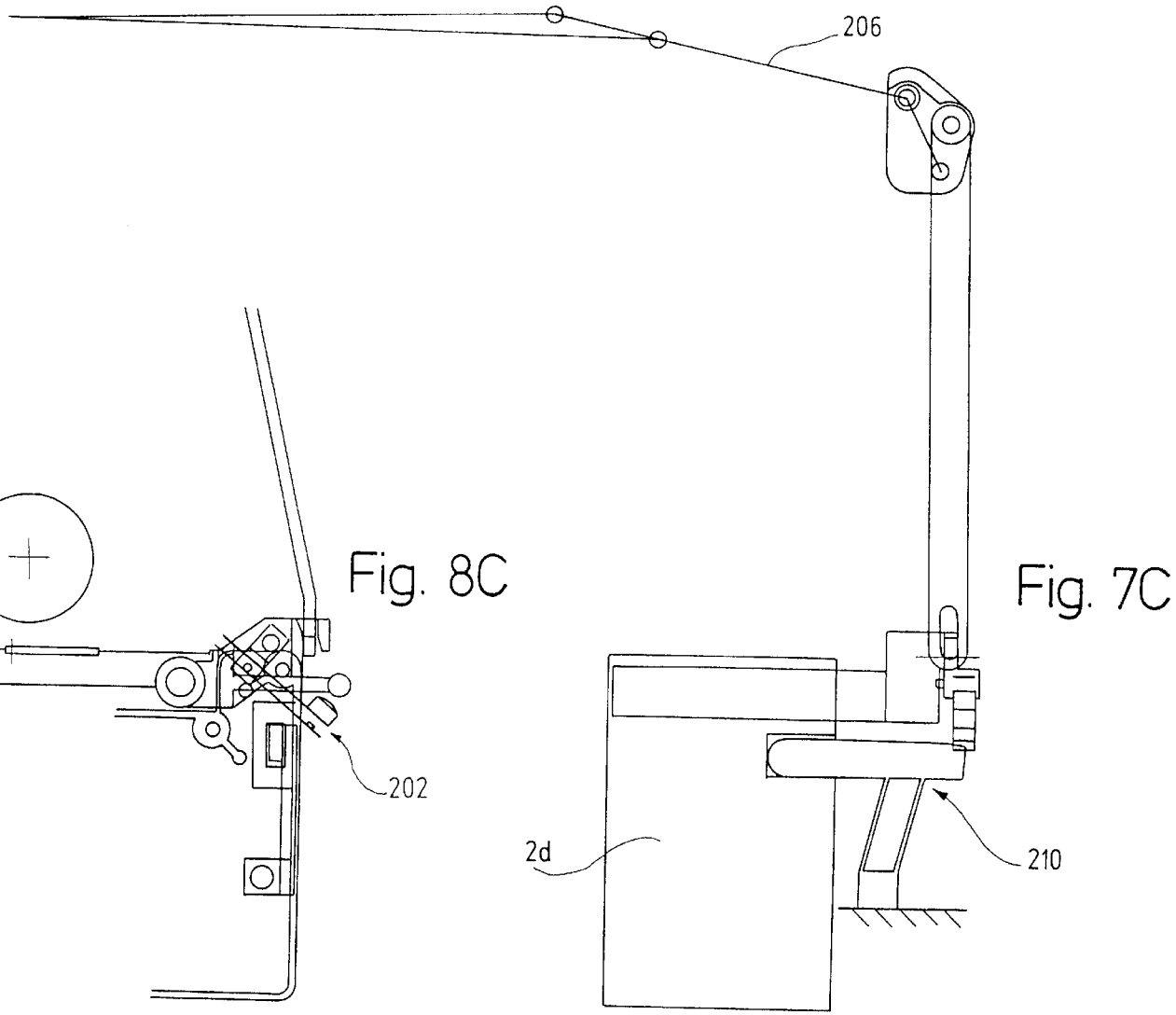

FIGS. 7C and 8C illustrate the situation when a cassette has been inserted into the second cassette receiving portion, but with the door 206 in the open position. The cassette can be an ink ribbon cassette 4 or can be a direct thermal cassette 2*d*, with the extended part 60 acting on the switch actuator 210.

Figure 7D:
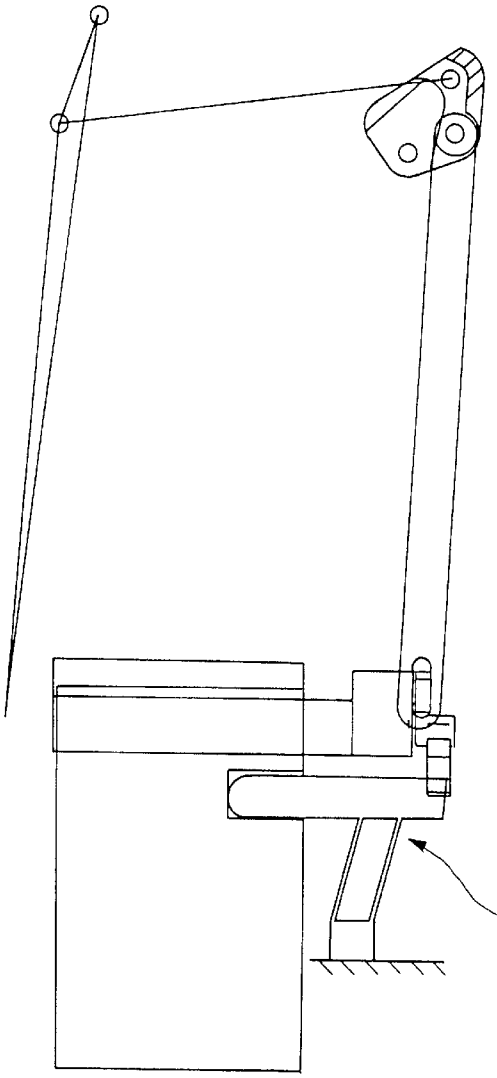
Figure 8D:
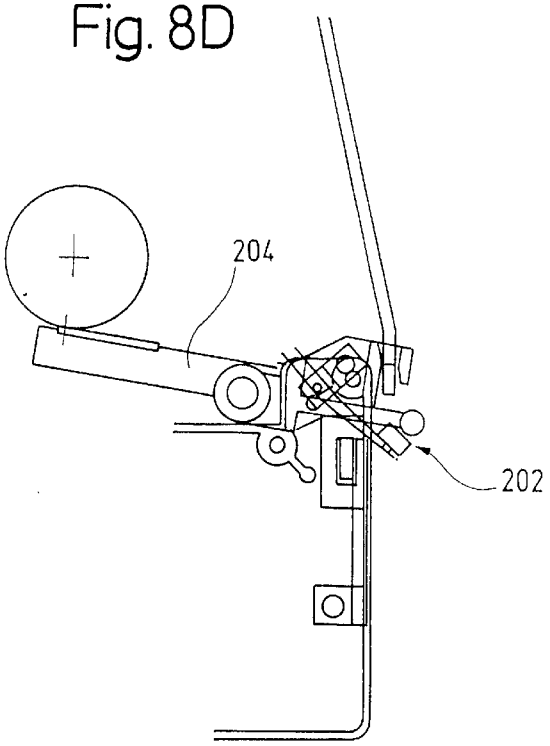

In that situation, the switch actuator 210 is moved resiliently to the right in FIG. 7C to bring it into a position where it will now prevent the switch 202 from moving too far to the left in FIG. 8C. In FIG. 8C, the door 206 is open and therefore the terminals of the switch 202 are not closed. However, as can be seen in FIGS. 7D and 8D, when the door is shut, and the printhead arm 204 is moved, the switch 202 is moved so that it abuts against the switch actuator 210 and therefore the terminals of the switch are closed. In this position, the printing device will operate.

We claim:

1. A set of tape holding cases including at least two cases of a first type and at least two cases of a second type, with cases of the first type housing image receiving tape of respectively different tape parameters and cases of the second type housing image transfer tape of respectively different tape parameters, wherein each case of the first type is received within a first receiving bay in a printer, and each case of the second type is received within a second receiving bay in a printer, the printer being operable only when two cassettes are inserted, and further wherein each case of the first type has a first cooperating means, depending on the tape parameter of image receiving tape, and each case of the second type has a second cooperating means, depending on the tape parameter of image transfer tape, and the first and second cooperating means being arranged to selectively cooperate with each other to allow cooperation only of properly selected case of the first type with any one of the cases of the second type and otherwise to exclude cooperation of the cases.

2. A set according to claim 1, wherein one of the first and second cooperating means comprises a component extending from the tape holding case, the shape of the component being dependent on the tape parameter of the tape.

3. A set according to claim 2, wherein the other of the first and second cooperating means comprises a recess defined in the tape holding case, the shape of the recess depending on the tape parameter of the tape and being arranged to accommodate the component of only the properly selected tape holding case.

4. A set according to claim 1 wherein the tape holding cases of the first type include cases housing tape of respectively first and second tape parameters and wherein tape holding cases of the second type include cases housing tape of respectively first and second tape parameters, wherein tape holding case of the second type include cases housing tape of respectively first and second tape parameters, wherein a tape holding case of the first type with tape of the first tape parameter can cooperate only with a tape holding case of the second type having tape of the first tape parameter and not with a tape holding case of the second type having tape of the second tape parameter.

5. A set according to claim 4 wherein the tape holding cases of the first type include cases having tape of a plurality (n) of different tape parameters, where n>2, and wherein tape holding cases of the second type having tape of a first tape parameter can cooperate with a first group of said plurality and tape holding cases of the second type housing tape of a second tape parameter can cooperate with a second group of said plurality.

6. A set according to claim 5 wherein one of said tape holding cases of the first group also belongs to the second group.

7. A set according to claim 1 wherein one case of either the first or second type has an interlock element adapted to cooperate with a recess of one case of the other type, and another case of the first or second type has an interlock element adapted to cooperate with a recess of another case of the other type, wherein the interlock element of the one case will not cooperate with the recess of said another case.

8. A set according to claim 7 wherein the cases of the second type carry the interlock elements and wherein a further case of the first type has a recess which will cooperate with the interlock elements of both the one and another cases of the first type.

9. A set according to claim 1 wherein one tape parameter is width.

10. A thermal printing device having a first cassette receiving portion for receiving a first tape holding case housing a supply of image receiving tape;

a second cassette receiving portion for receiving a second tape holding case housing a supply of image transfer ribbon capable of printing an image;

means for moving the image receiving tape through a printing zone in overlap with said image transfer ribbon so that an image can be transferred from the image transfer ribbon onto the image receiving tape, wherein the first and second tape holding cases are each selectable from first and second groups so as to be individually removable and replacable, said groups constituting a set of tape holding cases according to claim 1.

11. A thermal printing device having:

a first cassette receiving portion for receiving a first tape holding case housing a supply of image receiving tape on which an image is to be printed;

a second cassette receiving portion for receiving a second tape holding case housing a supply of image transfer ribbon;

means for moving the image receiving tape through a printing zone at which a thermal printing mechanism operates to transfer an image onto the image receiving tape, wherein the first cassette receiving portion can accommodate any one of a plurality of first tape holding cases including at least one tape holding case containing a supply of direct thermal tape and having cooperating means to exclude the possibility of inserting a second tape holding case into the second cassette receiving portion; and wherein the first cassette receiving portion includes means for detecting that a first tape holding case housing direct thermal tape has been inserted.

12. A printing device according to claim 11 wherein the cooperating means of the first tape holding case housing direct thermal tape includes a component extending from the tape holding case so that when inserted it extends into the second cassette receiving portion to exclude the possibility of inserting a second tape holding case housing image transfer ribbon.

13. A printing device according to claim 11 wherein the second cassette receiving portion includes a switch actuatable by a second tape holding case when present to indicate an operative state, and wherein the first tape holding case containing direct thermal tape is configured to activate said switch.

14. A thermal printing device according to claim 1 which comprises a controller for determining whether or not the first tape holding case includes image receiving tape or direct thermal tape, and altering the energy supplied to the thermal printing mechanism in accordance with such determination.

15. A set of tape holding cases including at least a case holding direct thermal tape, a case holding image receiving tape and a case holding image transfer ribbon, wherein the case holding image receiving tape and the case holding image transfer ribbon have respective cooperating means to allow them to be inserted together into a printing device, and wherein the case holding direct thermal tape is configured to exclude the possibility of the case holding image transfer tape being inserted into the printing device.

* * * * *

UNITED STATES PATENT AND TRADEMARK OFFICE
CERTIFICATE OF CORRECTION

PATENT NO. : 5,857,788

DATED : January 12, 1999

INVENTORS : Graham Scott Gutsell et al.

It is certified that error appears in the above-identified patent and that said Letters Patent is hereby corrected as shown below:

Column 10, line 22 (claim 14, line 1): change "1" to --11--.

Signed and Sealed this

Eleventh Day of May, 1999

*Attest:*

Q. TODD DICKINSON

*Attesting Officer*

*Acting Commissioner of Patents and Trademarks*